United States Patent [19]

Tikhonovich et al.

[11] Patent Number: 4,473,348

[45] Date of Patent: Sep. 25, 1984

[54] METHOD FOR PULSE-BURNING FUEL GASES IN INDUSTRIAL FURNACES

[75] Inventors: Dolbenko E. Tikhonovich; Semenov N. Nikolaevich; Gussak L. Abramovich; Astafiev A. Alexandrovich; Khazanov M. Semenovich; Moroz V. Iosifovich; Semenov E. Semenovich, all of Moscow; Eletsky S. Alexandrovich, Volgodonsk, all of U.S.S.R.; Silvio Borrello; Pietro Tixi, both of Genoa, Italy

[73] Assignees: Nauchno-Proizvodstvennoe Obiedinenie Po Tekhnologii Mashinostroenia "TSNIITMASH", Moscow, U.S.S.R.; Italimpianti Societa Italiana Impianti p.A., Genoa, Italy

[21] Appl. No.: 292,926

[22] Filed: Aug. 14, 1981

[30] Foreign Application Priority Data

Aug. 18, 1980 [SU] U.S.S.R. ..... 3006485

[51] Int. Cl.[3] ..... F23C 11/04; F23Q 9/00

[52] U.S. Cl. ..... 431/1; 431/284; 431/285; 431/158; 432/25

[58] Field of Search ..... 431/1, 2, 6, 158, 175, 431/181, 183, 187, 278, 284, 285, 353, 354, 12; 266/44, 252, 261; 432/25, 24

[56] References Cited

U.S. PATENT DOCUMENTS

| | | | |
|---|---|---|---|
| 2,777,508 | 1/1957 | Jurisich | 431/284 |
| 3,115,924 | 12/1963 | Massier | 431/284 |
| 3,194,295 | 7/1965 | Marchal et al. | 431/158 |
| 3,802,827 | 4/1974 | Semenov et al. | 431/285 |
| 3,969,069 | 7/1976 | Knaak | 432/25 |

*Primary Examiner*—Randall L. Green

*Attorney, Agent, or Firm*—Berman, Aisenberg & Platt

[57] ABSTRACT

The burner for metallurgical furnaces comprises a main combustion chamber (7) and an auxiliary combustion chamber (5) presenting a plurality of outlet channels (6) communicating with the main combustion chamber (7). To the main combustion chamber there is fed in a pulsating manner a primary mix of fuel gas and air in stoichiometric ratio, and, during the intervals between the feed pulses, a secondary mix of fuel gas and air with a coefficient of excess air of 1.15 to 1.35 and at a rate of flow corresponding to 1 to 3% of the nominal rate of flow. To the auxiliary combustion chamber (5) there is instead continuously fed an auxiliary mix of fuel gas and air with a coefficient of excess air of 0.65 to 0.85 and at a rate of flow corresponding to 1 to 3% of the rate of flow of the primary mix. The combustion products of the auxiliary mix stay in the auxiliary combustion chamber (5) for a very short time, more particularly for about from 0.005 to 0.01 sec., so that they still contain, when they enter into the main combustion chamber (7), active chemical substances, and particularly hydrogen atoms and radicals containing hydrogen atoms.

2 Claims, 3 Drawing Figures

METHOD FOR PULSE-BURNING FUEL GASES IN INDUSTRIAL FURNACES

BACKGROUND AND SUMMARY OF THE INVENTION

The present invention has for its object a method for the pulse-burning of fuel gases in industrial furnaces, particularly metallurgical furnaces, for example furnaces for the heating and the thermic treating of metallurgical products and metallurgical-mechanical products, by employing a burner comprising a main combustion chamber to which there is fed in a pulsating manner a primary mix of fuel gas and air in a substantially stoichiometric ratio, and an auxiliary combustion chamber to which there is fed in a continuous manner an auxiliary mix of fuel gas and air, and the combustion products of which auxiliary chamber enter continuously into the main combustion chamber.

The method above referred to is known from the following Soviet publication: Rapport of TSNIITMASH on the theme "The chioce of thermic furnaces, test of the pulse-burners employing fuel gas," theme No. 27, 20-1235.01 etap 53, Moscow, 1978. By this method, the pulses of feeding of the primary mix of fuel gas and air to the main combustion chamber are alternated with complete interruptions of the combustion in the main chamber. At the starting of each feeding pulse, the primary mix of fuel gas and air fed the main combustion chamber, is ignited (fired) thanks to the combustion products which flow out continuously from the auxiliary combustion chamber, to which the auxiliary mix of fuel gas and air is fed in a continuous manner.

The known method presents however the inconvenience that the ignition (firing) of the primary mix of fuel gas and air inside the main combustion chamber takes place in a sudden manner and causes, particularly whenever the main combustion chamber is cold, strong pressure blows both in the said main combustion chamber and in the ducts supplying the fuel gas and the air upstream of the burner. The said pressure blows damage the refractory blocks of the main combustion chamber, by subjecting them to remarkable stresses which determine their premature breaking. Moreover, the said pressure blows cause unbalances and alterations in the pressures and in the rates of flow of the fuel gas and of the air upstream of the burner, so that the ratio between the fuel gas and the air in the primary mix fed to the main combustion chamber comes to be different, during transitional time periods, from the predetermined stoichiometric ratio, thus reducing the efficiency of the combustion. Moreover, by employing the known methods of the above mentioned type, also the instant of ignition (firing) of the primary mix of fuel gas and air in the main combustion chamber results to be imprecise and unstable and can be very much delayed.

The invention has for its object to eliminate the inconveniences of the known methods, by improving the above referred method in such a manner as to stabilize and render more gradual and precise the ignition of the primary mix of fuel gas and air inside the main combustion chamber, and to avoid strong pressure blows at the moment of the ignition thus eliminating the respective stresses on the refractory blocks and increasing their life, as well as to avoid the temporary disorder of the predetermined stoichiometric ratio between the fuel gas and the air, thus ensuring in a continuous manner the optimum efficiency of the combustion.

The above problem is solved by the present invention by employing a method of the referred type and which is characterized substantially by the fact that alternatingly to the pulses of feeding of the primary mix of fuel gas and air in substantially stoichiometric ratio, that is during the intervals between the feed pulses of the said primary mix, there is fed to the main combustion chamber a secondary mix of fuel gas and air with a coefficient of excess air of 1.15 to 1.35,preferably 1.2, and at a rate of flow corresponding to about 1 to 3%, preferably 2%, of the nominal rate of flow of the primary mix of fuel gas and air in stoichiometric ratio, while the auxiliary mix of fuel gas and air presents a coefficient of excess air of 0.65 to 0.85, preferably 0.8, and it is fed to the auxiliary combustion chamber at a rate of flow corresponding to about 1 to 3%, preferably 2%, of the nominal rate of flow of the primary mix of fuel gas and air in stoichiometric ratio.

Preferably, according to a further feature of the invention, the combustion products of the auxiliary mix of fuel gas and air stay in the auxiliary combustion chamber for such a short time that, when they enter into the main combustion chamber, they still contain active chemical substances, particularly hydrogen atoms and radicals containing hydrogen atoms.

The invention provides also for a preferred apparatus for carrying out the above mentioned method. The said apparatus comprises a main combustion chamber provided with an outlet channel and with an inlet channel, the said inlet channel being connected, by means of a mixer device for mixing the fuel gas and the air, to an adjustable feeder device operating in a pulsating manner for feeding fuel gas and air, in a ratio and at a rate of flow which can be automatically varied according to a predetermined program, swirling devices being also provided which are suitable for imparting a swirling motion to the primary mix of fuel gas and air, fed in a pulsating manner to the main combustion chamber, there being also provided an auxiliary combustion chamber comprising an electric ignition (firing) plug, said auxiliary chamber presenting a plurality of outlet channels communicating with the main combustion chamber, as well as an inlet duct connected to a continuous feeder device for feeding an auxiliary mix of fuel gas and air. According to the invention, the said apparatus is characterized by the fact that the auxiliary combustion chamber presents a volume which is such that the stay time at its interior of the combustion products of the auxiliary mix of fuel gas and air corresponds to about 0.005 to 0.01 sec.

The auxiliary combustion chamber can be constructed in various manners and, by way of example, it can be annular, cylindrical or spherical, coaxial to the main combustion chamber, while the outlet channels from the said auxiliary combustion chamber can open into the initial portion, which is generally shaped in a flaring-out manner, of the main combustion chamber, or into the inlet channel of said main chamber.

The above and other characteristic features of the invention, and the advantages deriving therefrom will appear in a more detailed manner, from the following description, made by way of non-limiting example, with reference to the annexed drawings.

DESCRIPTION OF THE PREFERRED EMBODIMENTS

Figure 1:
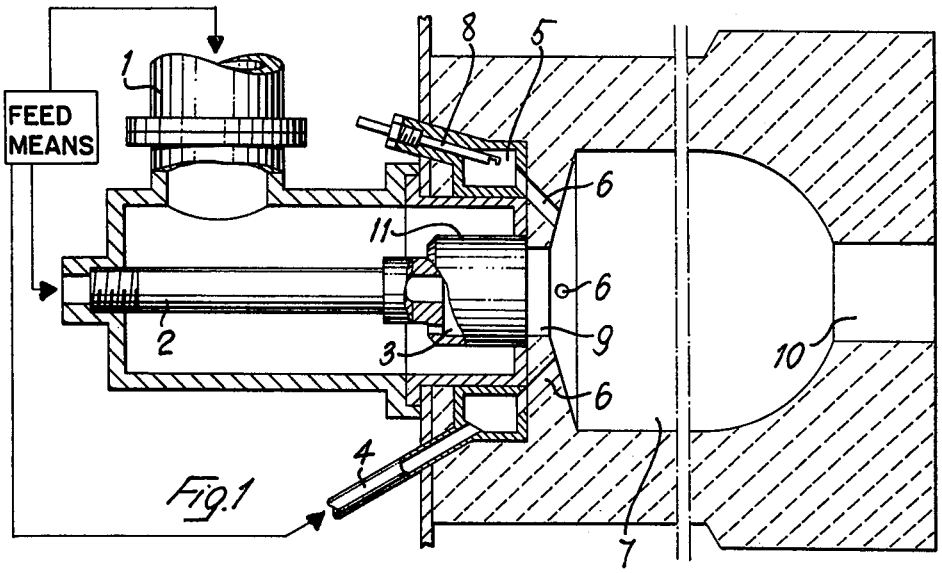
FIGS. 1, 2 and 3 show diagrammatically in axial section three different embodiments of an apparatus for carrying out the method according to the invention.

In the embodiment according to FIG. 1, the apparatus for carrying out the method according to the invention consists of a main combustion chamber 7, defined by refractory blocks and provided coaxially with an inlet channel 9 and with an outlet channel 10. The outlet channel 10 communicates with an industrial furnace (not shown), and particularly with a metallurgical furnace, for example a furnace for the heating or the thermic treatment of metallurgical and metallurgical-mechanical products. The inlet channel 9 of the main combustion chamber is instead connected with means for the pulse-feeding of a primary mix of fuel gas and air, with a ratio between the fuel gas and the comburent air (i.e. air which supports the combustion) which is variable and adjustable at will. Preferably, to the said primary mix there is imparted a swirling motion.

For this purpose, in the embodiment of FIG. 1, the comburent air fed by means of the pipe fitting 1, and the fuel gas fed by means of the pipe 2 are mixed together inside the mixer 3, and the primary mix of fuel gas and air thus obtained is fed to the inlet channel 9 of the main combustion chamber 7 in such a manner, and for example through a mechanical swirling device 11 of any known type, so as to confer to the said primary mix a swirling motion. The mixer 3 consists of a box provided at the extremity of the pipe 2 for feeding the fuel gas, and which box 3 is provided with channels for the inlet of the comburent air which is fed by means of the pipe fitting 1 into a chamber inside which there is housed the said mixer box.

The feeding of the comburent air to the pipe fitting 1 and the feeding of the fuel gas to the pipe 2 are effected by means of a feeding device of known type which is not shown, which effects the said feeding according to pulses which can be adjusted as to their frequency, as to their duration, and as to their interval, and controls also the rate of flow of the fuel gas and the rate of flow of the comburent air, simultaneously or individually, by maintaining constant or modifying their ratio, the whole also automatically and in a programmable manner.

All around the inlet channel 9 of the main combustion chamber 7 and coaxially thereto, there is provided an annular chamber 5 for the auxiliary combustion, connected to the duct 4 for the feeding of a mix of fuel gas and air. The auxiliary combustion annular chamber 5 presents a conical ring-like arrangement of inclined and converging outlet channels 6 which open into the combustion chamber 7. In the embodiment of FIG. 1, the said outlet channels 6 of the auxiliary combustion chamber 5 open into the initial portion, which flares out conically, of the main combustion chamber 7. At the interior of the auxiliary combustion chamber 5 there is inserted also an electric ignition plug 8 which is constructed in such a manner so as to serve also as device for the ionization of the gases at the interior of the said auxiliary chamber 5.

Figure 2:
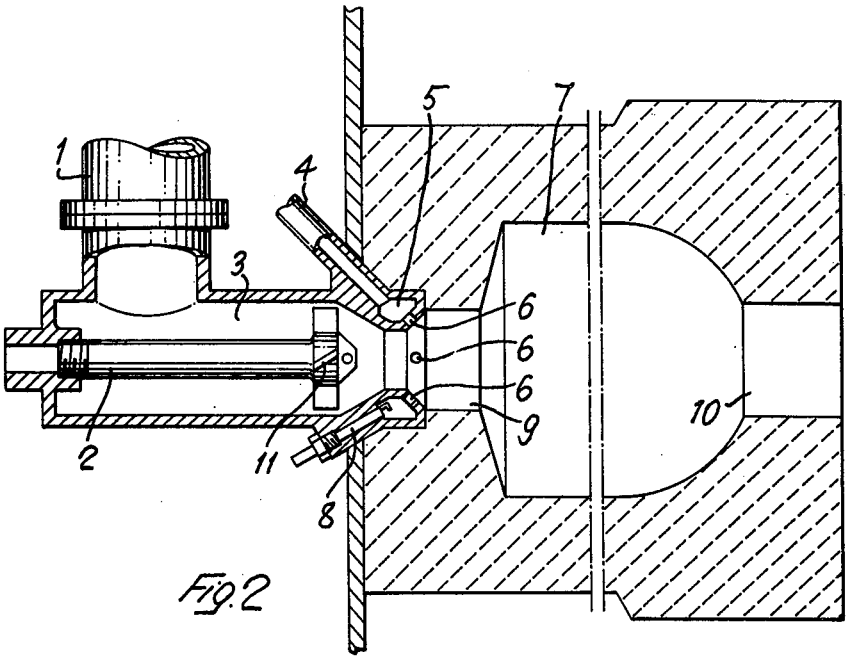
Figure 3:
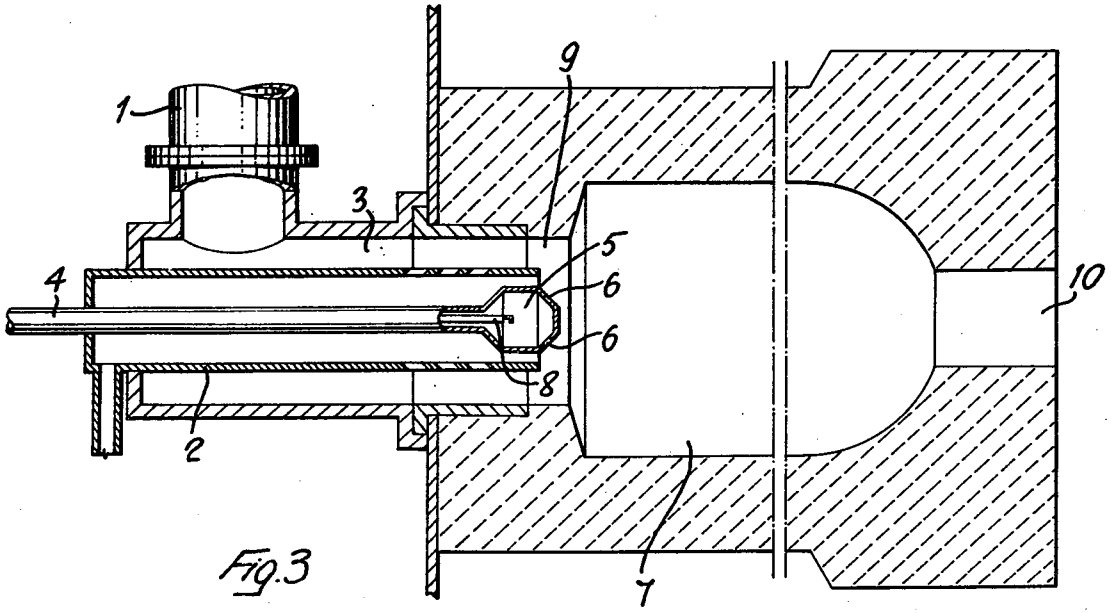

Referring to FIGS. 2 and 3, which show modified embodiments of the apparatus according to the invention, parts which are equal or equivalent to the parts already described in connection with the embodiment of FIG. 1, are indicated by the same reference numerals, so that their detailed description can be omitted.

The modified embodiment according to FIG. 2 differs from the embodiment of FIG. 1 in the fact that the inclined and converging outlet channels 6 of the auxiliary combustion annular chamber 5 open into the inlet channel 9 of the main combustion chamber 7, instead of opening directly into the initial portion of the said main chamber. The mixer 3 for mixing the air fed by means of the pipe fitting 1 and the fuel gas fed by means of the pipe 2, consists of a chamber, into which there opens the pipe fitting 2 and through which there projects the pipe 2, this latter being provided with one or more suitable outlet channels. The swirling device 11 for the primary mix of fuel gas and air to be fed to the main combustion chamber 7, consists of inclined or helical blades provided externally on pipe 2, at the interior of the chamber of the mixer 3.

The modified embodiment according to FIG. 3 differs from the embodiments according to FIGS. 1 and 2, in the fact that the auxiliary combustion chamber 5 in not annular, but instead it is cylindrical, or spherical, or ovoidal, or the like, and it is arranged centrally with respect to the inlet channel 9 of the main combustion chamber 7. The inclined outlet channels 6 of the auxiliary combustion chamber 5 are diverging, instead than converging, and open into the inlet channel 9 of the main combustion chamber 7. The pipe 4 for the feeding of the auxiliary mix of fuel gas and air to the auxiliary combustion chamber 5 is arranged at the interior of the pipe 2 for the feeding of the fuel gas for the primary mix. The mixer 3 for forming the primary mix of fuel gas and comburent air consists, also in this case, of a chamber, inside which there opens the pipe fitting 1 for the feeding of the comburent air and through which there projects the pipe 2 for the feeding of the fuel gas. The said pipe 2 presents side channels which open into the chamber of the mixer 3. The swirling device 11 is not present. The ignition plug 8 is introduced into the auxiliary chamber 5 through the pipe 2 for the feeding of the auxiliary mix of fuel gas and air.

According to the invention, the embodiments of FIGS. 1 to 3 present the common characteristic feature that the auxiliary combustion chamber 5 has a volume V which is such that the stay time "t" of the combustion products of the auxiliary mix of fuel gas and air at the interior of said auxiliary combustion chamber is such a short time so as to leave active chemical substances, and particularly hydrogen atoms and radicals containing hydrogen atoms, in combustion products which flow out of the auxiliary combustion chamber 5 through its outlet channels 6 and enter into the main combustion chamber 7. In order to obtain this result, the said stay time "t" must be in the order of 0.005 to 0.01 sec. The corresponding volume V of the auxiliary combustion chamber 5 can be determined with the help of the following formula:

$$V = t \cdot (Q/K) \cdot (Tp + 273)/(To + 273)$$

in which:

V = volume of the auxiliary combustion chamber expressed in $m^3$ (cubic meters).

Q = rate of flow of the auxiliary mix of fuel gas and air, expressed in $m^3$/sec. (cubic meters per second).

K = coefficient relating to the shape of the chamber.

Tp = temperature of the combustion products in the auxiliary combustion chamber, expressed in °C.

To=temperature at which it has been measured the rate of flow of the auxiliary mix of fuel gas and air.

t=stay time of the combustion products in the auxiliary combustion chamber.

Moreover, according to the invention, to the auxiliary combustion chamber 5 there is fed in a continuous manner an auxiliary mix of fuel gas and air with a coefficient of excess air of about 0.8 and with a rate of flow corresponding to about 1–3%, preferably about 2% of the nominal rate of flow of the primary mix of fuel gas and air in stoichiometric ratio, fed in steady condition to the main combustion chamber 7. Upon starting of the burner, the said auxiliary mix of fuel gas and air is ignited by the ignition plug 8. After the said ignition and after the stabilization of the combustion of the auxiliary mix at the interior of the auxiliary chamber 5, the plug 8 is caused to operate as a detector of the degree of ionization of the auxiliary mix of fuel gas and air and/or of the combustion gases of said mix.

Upon starting of the burner, and after having ignited the auxiliary mix inside the auxiliary combustion chamber 5, to the main combustion chamber 7 there is fed (by means of the feeder connected to the pipe fitting 1 for the comburent air and to the pipe 2 for the fuel gas) a secondary mix of fuel gas and air with a coefficient of excess air of about 1.2 and with a rate of flow corresponding to about 1 to 3%, and preferably 2%, of the nominal rate of flow of the primary mix of fuel gas and air in stoichiometric ratio, fed in steady condition to the said main combustion chamber 7.

This secondary mix of fuel gas and air is ignited by the combustion products of the auxiliary mix, which products pass from the auxiliary combustion chamber 5 through the channels 6 into the main combustion chamber 7.

After the ignition and stabilization of the combustion of the secondary mix at the interior of the main combustion chamber 7, to the said chamber 7 there is fed (by means of the feeder device connected to the pipe fitting 1 and to the pipe 2) a primary mix of fuel gas and air, with a substantially stoichiometric ratio and with a predetermined nominal rate of flow. The feeder device is programmed and adjusted so as to feed the main combustion chamber 7 in a pulsating manner with the said primary mix of fuel gas and air in stoichiometric ratio and at a nominal rate of flow, by alternating to the pulses of primary mix, the feeding of the said secondary mix of fuel gas and air with a coefficient of excess air of 0.8 and with a rate of flow of about 1 to 3%, preferably 2%, with respect to the nominal rate of flow of the primary mix.

Consequently, under steady conditions, the combustion at the interior of the main chamber 7 is never completely interrupted, since the periods of combustion of the primary mix which is fed in a pulsating manner, alternate with periods of combustion of the secondary mix. The ignition (firing) and the combustion of the said primary and secondary mixes are ensured and controlled by the continuous flow of the combustion products of the auxiliary mix from the auxiliary chamber 5 to the main chamber 7, the said combustion products being particularly active due to their short stay time inside the auxiliary combustion chamber and to their content of active chemical substances, particularly hydrogen atoms and radicals containing hydrogen atoms.

Under these conditions, the ignition (firing) of the primary mix of fuel gas and air, fed in a pulsating manner with stoichiometric ratio and at nominal rate of flow to the main combustion chamber 7, takes place with just a very short delay period, in a precise and stable manner and what is more important gradually, thus avoiding the pressure blows which up to the present time took place at the moment of firing of the said primary mix. Consequently, there are avoided the stresses and damages to the refractory blocks of the burner and particularly of the main combustion chamber 7. Therefore, the said refractory blocks have a longer duration. The absence of pressure blows and the ready, regular and stable ignition of the primary mix eliminate alterations of the adjustment of the ratio and ensure the holding of the stoichiometric ratio of said primary mix and a more complete combustion of same. It is therefore possible to increase the volume of the main combustion chamber, while the stop times of the furnace due to repair and maintenance works are reduced. In consideration of the uniformity and regularity of the ignition (firing) and of the combustion of the primary mix at the interior of the main combustion chamber, it is finally possible to favour the reduction also of the specific consumption of fuel gas, for example for each ton of metallurgical or metallurgical-mechanical product to be heated or to be thermally treated.

It is believed that the invention will have been clearly understood from the foregoing detailed description of some preferred embodiments. Changes in the details of construction and operation may be resorted to without departing from the spirit of the invention, and it is accordingly intended that no limitation be implied and that the hereto annexed claims be given the broadest interpretation to which the employed language fairly admits.

We claim:

1. A method for the pulse-burning of fuel gases in industrial furnaces, particularly metallurgical furnaces, for example furnaces for the heating and thermic treating of metallurgical products and metallurgical-mechanical products, by employing a burner comprising a main combustion chamber (7) to which there is fed in a pulsating manner a primary mix of fuel gas and air in substantially stoichiometric ratio, and an auxiliary combustion chamber (5) to which there is fed in a continuous manner an auxiliary mix of fuel gas and air, the combustion products of said auxiliary mix entering in a continuous manner into the main combustion chamber (7), characterized by the fact that alternatingly with the pulses of the feeding of the primary mix of fuel gas and air in substantially stoichiometric ratio, that is in the intervals between the pulses of the feeding of the said primary mix, to the main combustion chamber (7) there is fed a secondary mix of fuel gas and air with a coefficient of excess air of 1.15 to 1.35, and preferably of 1.2, and at a rate of flow corresponding to about 1 to 3%, and preferably 2%, of the nominal rate of flow of the primary mix of fuel gas and air in stoichiometric ratio, while the auxiliary mix of fuel gas and air presents a coefficient of excess air of 0.65 to 0.85, preferably of 0.8, and it is fed to the auxiliary combustion chamber (5) at a rate of flow corresponding to about 1 to 3%, preferably 2%, of the nominal rate of flow of the primary mix of fuel gas and air in stoichiometric ratio.

2. A method according to claim 1, characterized by the fact that the combustion products of the auxiliary mix of fuel gas and air stay in the auxiliary combustion chamber (5) for such a short time that, when they enter into the main combustion chamber (7), they still contain active chemical substances, more particularly hydrogen atoms and radicals containing hydrogen atoms.

* * * * *